US006695323B2

(12) United States Patent
Bäcklund

(10) Patent No.: US 6,695,323 B2
(45) Date of Patent: Feb. 24, 2004

(54) SNOWBOARD ACCESSORY

(75) Inventor: Jon Bäcklund, Vännäs (SE)

(73) Assignee: S.O.B. I Umea AB, Umea (SE)

( * ) Notice: Subject to any disclaimer, the term of this patent is extended or adjusted under 35 U.S.C. 154(b) by 0 days.

(21) Appl. No.: 10/137,830

(22) Filed: May 1, 2002

(65) Prior Publication Data

US 2002/0129997 A1 Sep. 19, 2002

Related U.S. Application Data

(63) Continuation-in-part of application No. PCT/SE00/02118, filed on Oct. 30, 2000.

(30) Foreign Application Priority Data

Nov. 4, 1999 (SE) ..... 9904048

(51) Int. Cl.[7] ..... A63C 5/03
(52) U.S. Cl. ..... 280/14.23; 188/6; 188/7
(58) Field of Search ..... 280/14.23; 24/442, 24/573.1; 188/6, 7, 8

(56) References Cited

U.S. PATENT DOCUMENTS 5,156,644 A * 10/1992 Koehler et al. ..... 280/14.23

FOREIGN PATENT DOCUMENTS

EP 0330620 A2 8/1989

* cited by examiner

*Primary Examiner*—Matthew C. Graham
(74) *Attorney, Agent, or Firm*—Darby & Darby

(57) ABSTRACT

The invention consists of a brake device for snowboards (5) comprising a fitting part (1, 2), which is attached to the board, and a braking part (3). The braking part (3) is attached to the fitting part (1, 2) and can be maneuvered from a non-braking position, in which all parts of the braking part (3) are situated on top of the board (5) and within the boundary edges of the board (5), to a braking position, in which the braking part (3) is situated essentially outside one of the boundary edges of the board (5) and extends below the board (5).

12 Claims, 4 Drawing Sheets

SNOWBOARD ACCESSORY

CROSS-REFERENCE TO PREVIOUS APPLICATIONS

This application is a continuation-in-part of international application Ser. No. PCT/SE00/02118, filed Oct. 30, 2000, which designated the United States.

The present invention relates to a brake device for snowboards.

When a skier is using skis and falls during a run, it is desirable for safety reasons for the skis to be released from the skier. In order to prevent a ski from sliding away in an uncontrolled fashion, the ski has a brake which functions in such a way that it adopts a braking position when the ski is released from the skier.

When a snowboard rider falls during a run, the board is not released from the rider. The rider's feet are securely attached to the board, even after a fall, and thus no brake is required in this situation. A brake on a snowboard must adopt a braking position when the rider consciously moves at least one foot from the board.

A snowboard moves more freely than a ski when it is in use. A snowboard is able to move in more directions than a ski. A brake device for a ski can be arranged with relatively few problems on the outside of the longitudinal sides of the ski and, in the non-braking position, parallel with the ski. A projecting brake device on a snowboard impairs its use to such an extent that it does not actually constitute a conceivable alternative.

When riding a snowboard, it is important for the board to be balanced. For this reason, careful consideration is given to the position of every weight-increasing component on the board. A bulky and heavy brake device on a snowboard makes riding difficult and accordingly does not constitute an alternative either.

One object of the present invention is to make available to snowboard riders a brake device specially designed for snowboards. Further objects are to make available a brake device which is functional and safe, automatic, small and compact and easy to fit and use.

The object is achieved by means of a brake device having the characteristic features indicated in claim 1.

Two examples of such a brake device are described below with reference to the Figures.

Figure 1:
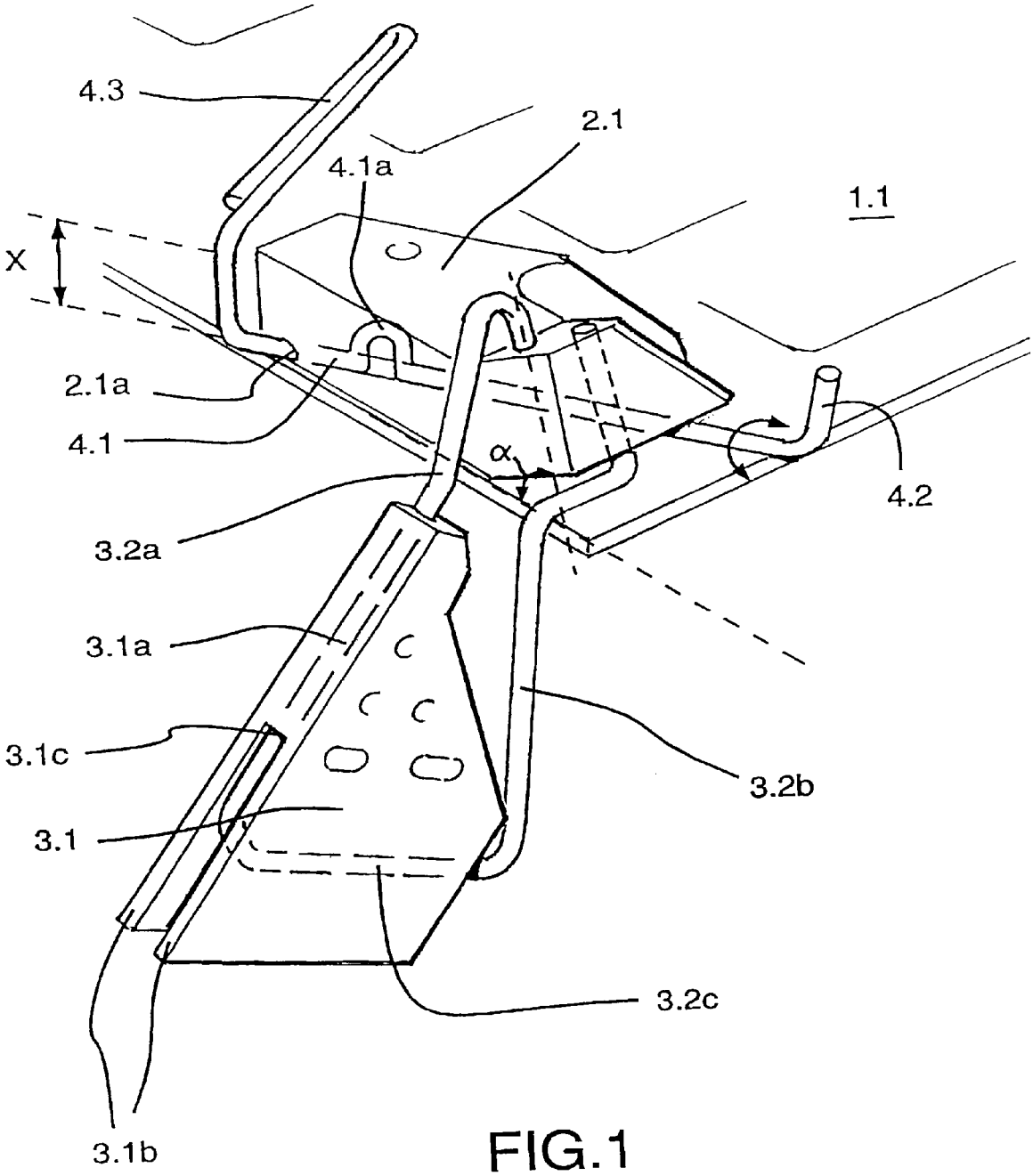
Figure 2:
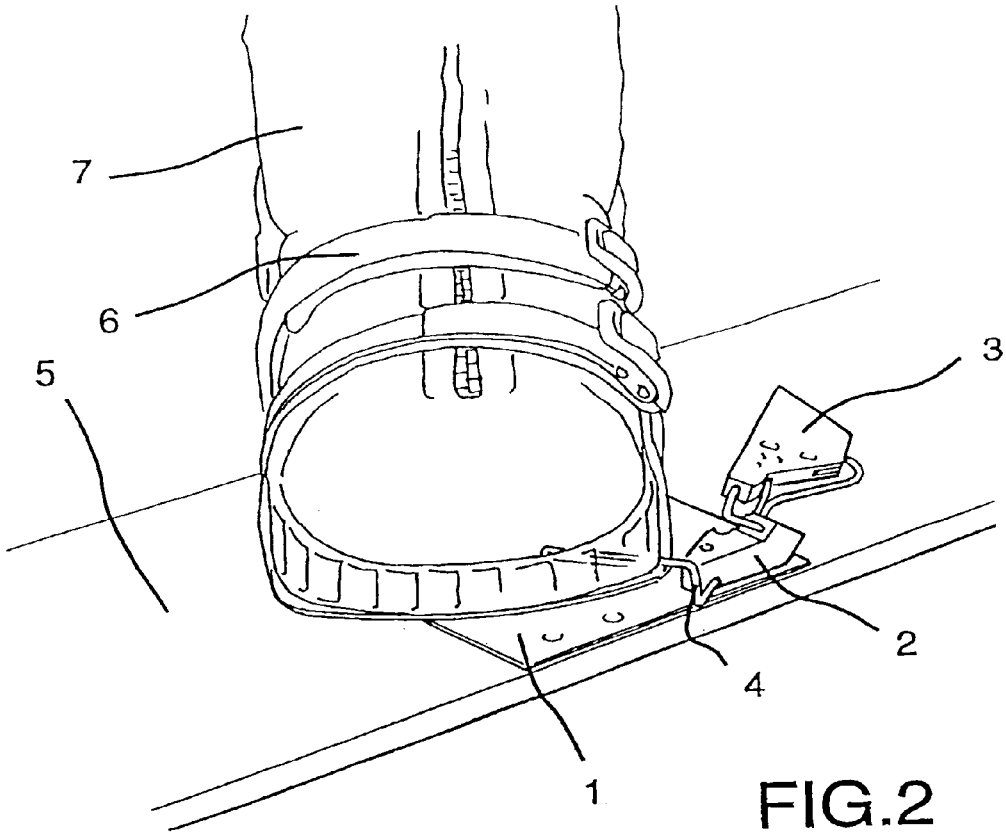
Figure 3:
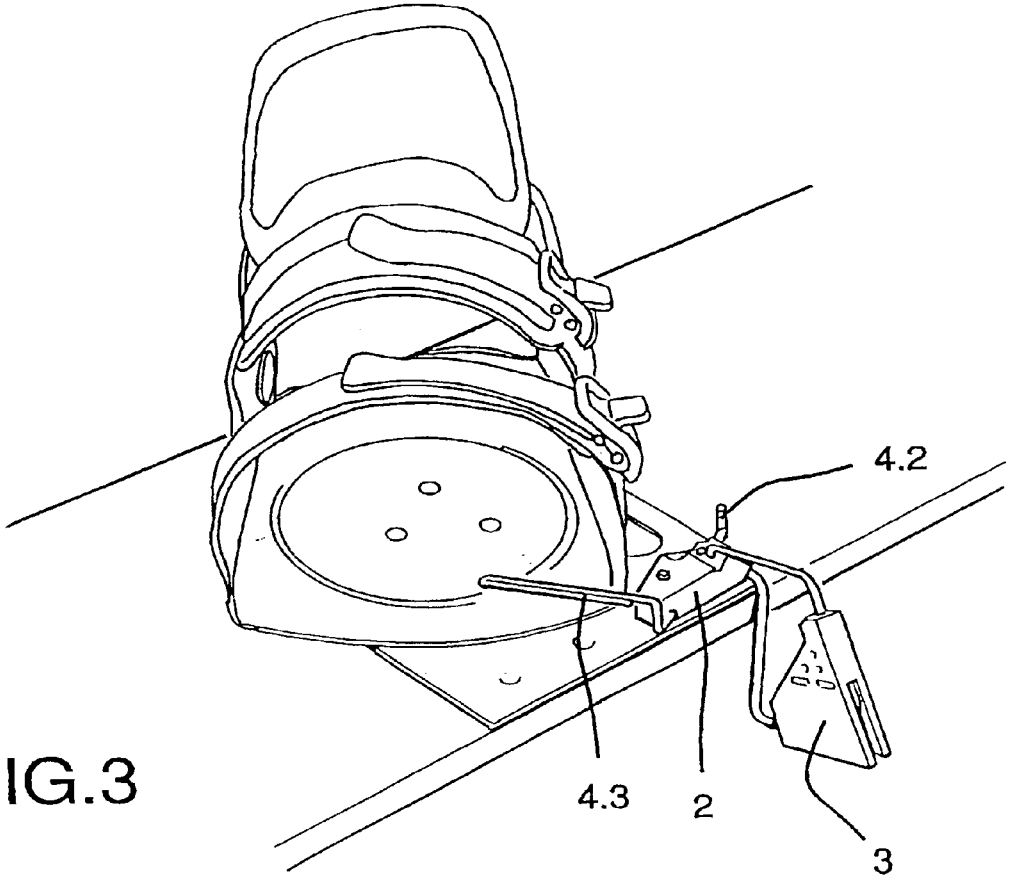
Figure 4:
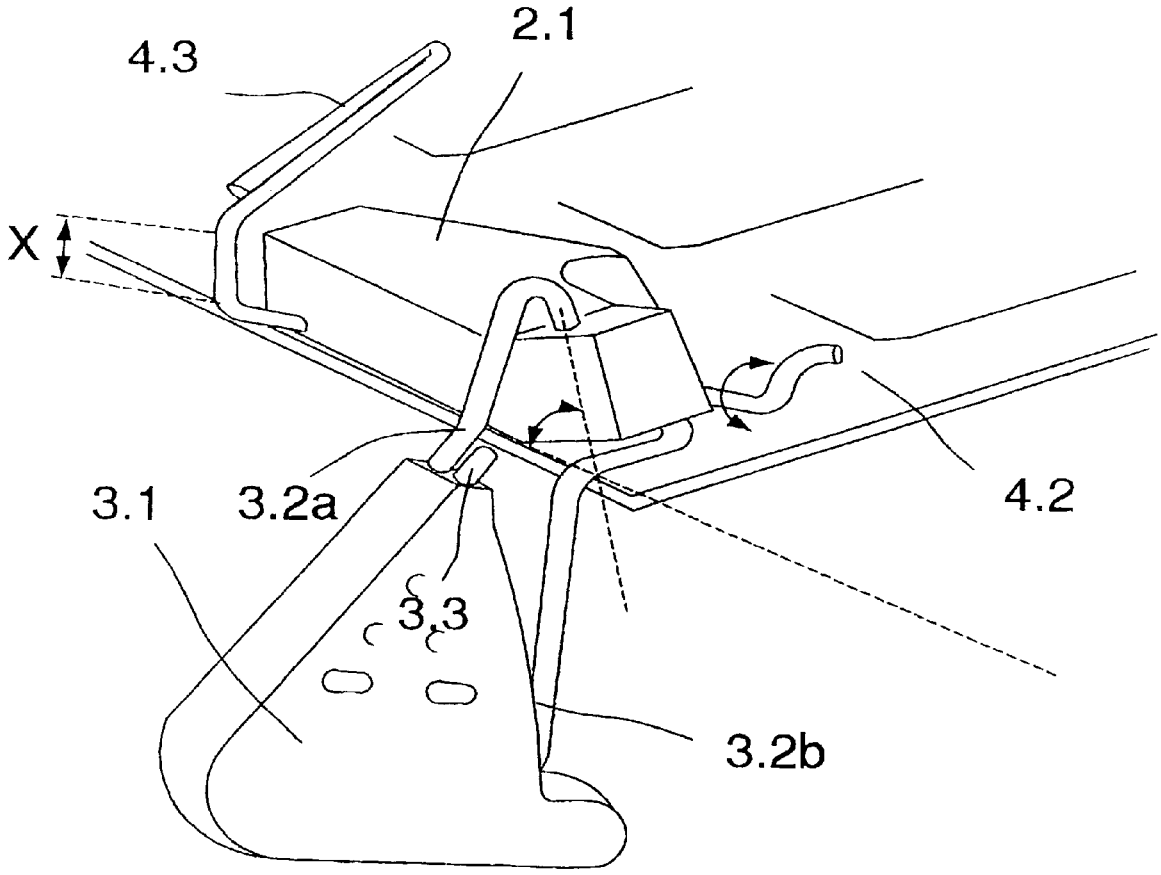
Figure 5:
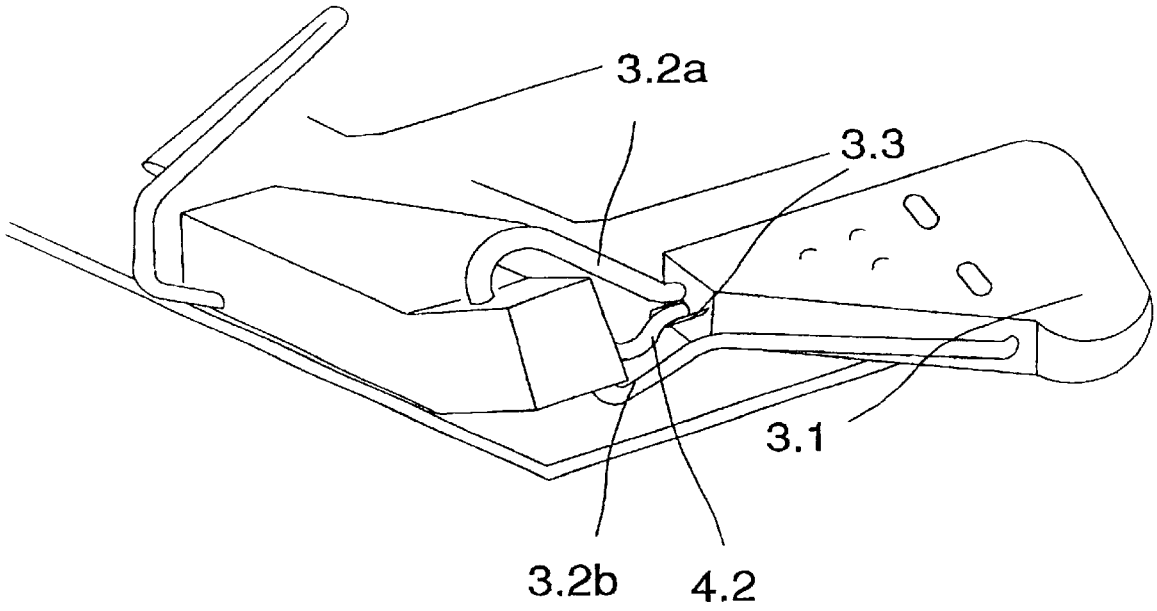

FIG. 1 shows a first embodiment of a brake device in accordance with the invention, FIG. 2 shows the brake device fitted on a snowboard in the non-braking position, FIG. 3 shows the brake device fitted on a snowboard in the braking position, FIG. 4 shows a second embodiment of the invention in braking position, and FIG. 5 shows the second embodiment in non-braking position.

A snowboard has two long sides and two short sides. A binding for each foot is fitted to the board. The bindings are usually fitted more or less transversely to the longitudinal direction of the board, and not in the longitudinal direction, as in the case of a ski, and at an appropriate distance from one another. The brake device shall be fitted on one long side of the snowboard and on the side of the board to which the rider faces. One part of the brake device is positioned under one of the bindings, while the rest of the device is positioned between the rider's feet. This positioning result in that the brake device is naturally protected by the bindings and the shoes, and that it does not get in the way when riding the board. The marginal increase in weight contributed by the device is not noticeable when the device is positioned directly beneath the rider and as such represents a constant and permanently located addition to the weight of the rider and the board.

When the rider wishes to attach the board to his/her feet, the brake device is in the braking position. The rider attaches the bindings to his/her shoes and can then manoeuvre the brake device to a non-braking position or attaches the binding to one of his/her shoes and can then manoeuvre the brake device to a non-braking position with his/her non-attached free foot. This non-braking position is maintained with the help of one of the rider's feet and remains effective until the rider him/herself releases the foot from the board. The brake device is activated when the foot is removed.

The brake device brakes the board when it is not in use and prevents the board from sliding away without a rider who can control its movements and speed. The brake must be positioned so that it is also possible for the rider to propel himself/herself with one foot on the board and the other foot released from the board. In this position, the rider can kick with his/her free foot to move forwards over level ground or up an incline, for example at ski lifts. The rider can also improve his/her balance when travelling on a ski lift if one foot is released from the board. The foot remaining on the board must be the foot which retains the brake device in the braking position. The brake device is accordingly not activated in the aforementioned propulsion position. The front foot is usually kept on the board, and this means that the brake device must be fitted so that it is operated by the rider's front foot.

The brake device comprises a fitting part 1, an attachment part 2, a braking part 3 and a locking device 4. See FIG. 1, FIG. 2 and FIG. 3 showing a first embodiment of a brake device in accordance with the invention.

The fitting part 1 comprises a plate 1.1 arranged on the upper side of a snowboard 5. Depending on the choice of material and its size, the plate 1.1 can be provided with material reductions in the form of recesses in order to minimize the weight. The plate 1.1 has a thickness such as to permit the fitting of a binding 6 above the plate without causing the binding and a shoe 7 positioned therein to be too high. The outer form of the plate 1.1 is adapted to the form and contours of the board 5 and the binding 6. The plate 1.1 is attached in a previously disclosed manner, appropriately with screws. The plate is manufactured from a durable material capable of withstanding both the load of the rider and the stresses that arise when riding. The material must be selected so that the plate does not contribute unnecessary additional weight.

The attachment part 2 performs its function as part of the fitting part 1. The attachment part 2 comprises a body 2.1 arranged on the upper side of the plate. The body 2.1 accommodates or is connected to the other parts of the device. The body 2.1 is a connecting link between the fitting part 1 and the braking part 3 and houses parts of the locking device 4. The body 2.1 is a separate part which is fitted to the plate 1.1 with fixing elements. Since the body and the plate are separate parts, the position of the body can be freely selected within the physical boundaries of the plate, and the position can even be varied on a later occasion. The attachment part can, however, be constructed as a part of the plate, if it is desirable to have an extra-rigid and dimensionally stable construction, and it will then be part of the fitting part 1.

The braking part 3 comprises a brake heel 3.1, which is the active braking component. The brake heel 3.1 consists of a material body with constructional details that are effective in different ways. The brake heel 3.1 can be displaced between an active braking position and a passive non-braking position. In the braking position, the heel 3.1 is in the snow, essentially perpendicular to the longitudinal axis of the board. In the non-braking position, the heel is above the board, within the outer edges of the board, and is essentially parallel with the board. The brake heel exhibits a form which enables it to penetrate into the snow easily. It exhibits a form such that, as it moves into its braking position, it cuts down into the snow and the braking surface is large.

The braking part also comprises a brake loop 3.2 which connects the brake heel 3.1 to the attachment part 2. The brake loop 3.2 can be divided into two legs 3.2*a* and 3.2*b* and a web 3.2*c*. The ends of the two legs are accommodated in the body. The web and parts of the legs are accommodated in the brake heel. One leg 3.2*a* of the brake loop is arranged in a transcurrent opening 3.1*a* in the brake heel 3.1. The brake heel 3.1 can be displaced along this leg 3.2*a*. One end of the brake heel, which in the braking position faces down towards the snow, has two parallel side parts 3.1*b*, positioned at a selected distance from one another, which delimit a cavity in which the web 3.2*c* of the loop is positioned so that it is capable of displacement. The distance between the side parts essentially corresponds to the width of the web. The part of the brake heel which links the two side parts forms a bottom 3.1*c* which delimits the cavity and which, in conjunction with the web 3.2*c* of the loop, prevents the outward displacement of the brake heel along the leg 3.2*a*. The outsides of the side parts 3.1*b* are the surfaces which essentially constitute the braking surfaces of the device in contact with the snow and ice beneath the snowboard.

The two legs 3.2*a* and 3.2*b* of the brake loop are rotatably arranged in relation to the body 2.1. The brake loop 3.2 acts as a spring which can be tensioned and locked and subsequently released, in conjunction with which the stored energy is liberated. In the non-braking position, the loop is pretensioned by rotation and locking of the brake heel and the brake loop as a unit. Removing the locking releases the energy in the brake loop, in conjunction with which the brake loop and the brake heel are caused to rotate outwards from their locked position into their braking position. The parts of the brake loop and the attachment part are designed in such a way that the brake heel, in its braking position, is spring-assisted in one longitudinal direction of the board and rigid in the opposite direction. The brake heel has reached an end position when it is in the braking position.

The free end of one of the legs 3.2*a* is pivotally mounted and supported essentially in/on the upper side of the body 2.1. The mounting end faces essentially downwards at an angle. The angle a between the plane of the plate and the longitudinal axis of the mounting end lies in the interval 40–50°, preferably 45°. The leg 3.2*a* is curved in such a way that, when the device is in the braking position, it faces outwards over and away from the edge of the board 5 and down towards the snow. When the device is in the non-braking position, the leg is retracted inwards above the board and within the edges of the board and is essentially parallel with the board.

The free end of the other leg 3.2*b* is pivotally mounted and supported essentially in/on the under side of the body 2.1. The mounting end faces essentially upwards at an angle. The under side of the body is formed in such a way that it provides the loop leg 3.2*b* with limited space for movement. The leg is curved in such a way that, when the device is in the braking position, it faces outwards over and away from the edge of the board 5 and down towards the snow. When the device is in the non-braking position, the leg is retracted inwards above the board and within the edges of the board and is essentially parallel with the board.

Each longitudinal axis of the mounting ends of the brake loop legs 3.2*a* and b runs essentially parallel through the attachment part 2.

When the device is in the braking position, the web, surrounded by the brake heel, is down in the snow and essentially perpendicular to the longitudinal axis of the board and parallel with the under side of the board. When the device is in the non-braking position, the web is above and within the edges of the board and essentially parallel with the board.

The locking device 4 is elongated and comprises an arm part 4.1, which is arranged in the attachment part 2. The locking device is appropriately manufactured from a wire-like material, preferably metal. The arm part 4.1 is placed in a channel 2.1*a* in the body 2.1. The locking device 4 in this attachment can be rotated about its longitudinal axis. The channel 2.1*a* is arranged in the lower part of the body next to the fixing plate 1.1. The arm part 4.1 connects the two end parts of the locking device which project outwards to either side of the body. One end part is curved once to form a hook 4.2. The end part is angled in relation to the longitudinal axis of the arm part, preferably at a relatively right angle. The angle may be approximately 90°. The second end part is initially curved once, in the same direction as the hook, and then once more at a predetermined distance X from the centre axis of the arm to form a lever 4.3.

When the locking device 4 is in the unactuated position, it always falls in towards the board so that the lever lies down against the binding. This is because the locking device 4, in the event of an outward-directed rotation, reaches a stop position in which any residual energy associated with the construction of the locking device and other parts results in an inward-directed rotation in the opposite direction, which causes the locking device 4 to return to its original position. The locking device 4 reaches its stop position when one of the stop parts 4.1*a* constituting the locking arm 4.1 reaches a position in which the stop part 4.1*a* comes into contact with a stop surface 2.1*b* inside the channel 2.1*a* intended for the locking arm 4.1*a*. The stop part 4.1*a* is formed by providing the locking arm with a protrusion in a direction along a limited section of its extent. The protrusion is created by bending the wire which forms the entire locking arm at least into a 'U'-shape. The channel 2.1*a* in the body 2.1 of the attachment part is provided in its wall with a recess with a good fit with the stop part 4.1*a*. The maximum extent to which the locking device 4 is permitted to rotate is the point at which the stop part 4.1*a* makes physical contact with the stop surface 2.1*b* of the recess. The recess and its stop surface 2.1*b* and the stop part 4.1*a* are formed for interaction with one another, and the stop surface 2.1*b* which interacts with the stop part 4.1*a* is positioned so that the maximum permitted rotation of the locking device 4 is to a point at which the centre of gravity of the lever 4.3 is situated directly above the longitudinal axis of the locking device in stop position, with the result that the locking device is tilted back in the stop position. The lever can be constructed with a weight concentration at its outer end to influence the location of the centre of gravity.

The lever 4.3 lies essentially parallel with and above the base part of the binding 6. The distance X is selected so that the lever fits closely into the base part and can rest against it. The wire-like material is bent double at the end of the lever so that the lever 4.3 is rigid, but also to make the end blunt and to increase the weight in that part of the lever so that the locking device 4 tips over and assumes the desired position. This stability and weight increase can also be achieved through other embodiments. The lever can also lie down against a part of the board itself.

The stop part 4.1*a* and other surfaces in the recess in the channel 2.1 interact to lock the arm part 4.1 so that it cannot be displaced axially in the channel 2.1*a*.

The second embodiment of the invention also comprises a fitting part 1, an attachment part 2, a braking part 3 and a locking device 4, see FIGS. 4 and 5.

The braking part 3 comprises a brake heel 3.1 and a brake loop 3.2 which connects the brake heel 3.1 to the attachment part 2 and thereby to the fitting part 1. The brake loop 3.2 is divided into two legs 3.2*a* and 3.2*b*. One end of each leg is accommodated in the attachment part 2. The other end of each leg is accommodated in the brake heel 3.1. Each leg 3.2*a* and 3.2*b* of the brake loop is arranged into the body of the brake heel 3.1. The brake heel 3.1 is rigidly fixed to the brake loop 3.2.

The locking device 4 has the same construction as the locking device 4 previously described.

The braking heel part 2 comprises a projecting part 3.3. The projecting part 3.3 is arranged so that it will interact with a part, the hook 4.2, of the locking device 4 when the braking heel 3.1 is locked in non-braking position. The projecting part 3.3 is projecting from the brake heel 3.1, on the top of the brake heel when the brake heel is seen in braking position, and is directed parallel to one of the legs of the brake loop 3.2, the leg 3.2*a*. The projecting part 3.3 is slightly curved, it looks like a curved tongue or a half-pipe, and has a size allowing the part of the locking device to be partially surrounded by the part 3.3 when the part 3.3 and the part 4.2 are in interaction. The projecting part 3.3 is made of metal. The part of the locking device 4 holds down the projecting part 3.3 so that the brake heal is placed above the board, within the outer edges of the board, and essentially parallel with the board and stops it to move towards the snow.

It is, of course, entirely possible to design the constituent parts in a way other than that illustrated in the Figures, while retaining the same function. The appearance and the construction of the board, the binding and the shoe/boot are examples of factors which can influence the appearance and the construction of different parts. The manufacturing process and the choice of material also have an influence.

The brake device functions in the following way:

When the rider wishes to attach the board 5 to his/her feet, the brake device is in the braking position, as already mentioned. The brake heel 3.1 is directed down into the snow, the brake loop 3.2 is not tensioned, and the lever 4.3 of the locking device is lying down on the base part of one of the bindings 6. The locking device 4 is then already in the position which locks the brake device in the non-braking position.

The rider thus places his/her feet in the bindings 6. The foot which is placed in the binding when the lever 4.3 of the locking device is lying on the base part of the binding locks any further movement of the lever and, at the same time, the other locking device parts in this position. When the rider has fitted at least this foot to the board, he/she bends down and takes hold of the brake heel 3.1. The rider then raises and rotates the brake heel 3.1 up from the snow and in over the board 5 in a single movement. The act of raising the brake heel also causes the parts of the brake loop to rotate in relation to one another, in conjunction with which the loop 3.2, which acts as a spring, is tensioned. When the brake heel 3.1 is in the desired stop position, the rider displaces the brake heel 3.1 upwards along the brake loop leg 3.2*a* so that the brake heel comes into locking engagement with the hook 4.2 of the locking device. The brake device is now fully locked and will only be displaced into its braking position when the rider him/herself releases and moves the foot which is standing on the lever 4.3.

When the rider removes his/her foot so that the lever 4.3 is released, and with it the entire locking device 4, the brake loop 3.2, and with it the brake heel 3.1, will seek to return to its untensioned braking position thanks to the stored and inherent energy. The brake loop 3.2 and the brake heel 3.1 then pivot outwards from their non-braking position above the board 5 and continue downwards into their braking position at the edge of the board. The hook 4.2 of the locking device is guided out of the way by the brake heel 3.1 in conjunction with its outward displacement and rotates forwards and downwards towards the board in order subsequently, when the brake heel 3.1 has passed, to return automatically to its essentially upright original position. The lever 4.3 of the locking device falls back down onto the base part of the binding 6 and into its original position.

The brake device is constructed in such a way that the brake heel 3.1, when in its braking position, is in an end position which is rigid in one direction of movement of the board and spring-assisted in the other direction of movement of the board. This means that the brake has two braking positions with different braking force. When the board slides backwards, the brake heel 3.1 is in a rigid braking position and the board is stopped immediately and with maximum braking force. This immediate stopping effect is desirable if it is wished to prevent the board from sliding away rearwards.

The brake heel 3.1 is spring-assisted in the forward direction of the board. The brake heel 3.1 is spring-assisted in the direction in which it is caused to rotate as it returns to the non-braking position. If the board slides away forwards on a slope with a small incline, the board will not gain speed to any great extent. The brake will arrest the forward motion of the board practically immediately, when the generated braking force will be sufficient even if the brake heel is deflected a little against the spring. If the board slides away on a slope with a steep incline, the board will rapidly reach a high speed and the brake heel will spring back. The position of the brake heel on the side of the board and on the front part of the board causes it to act as a rotation point for the board. The board will rotate about the brake heel, and the front of the board will be caused to face in the opposite direction, i.e. up the incline. As the board now commences to slide down the slope once more, it will move backwards and will then be stopped immediately and with maximum braking force by the brake heel, which will then be in its rigid braking position.

The second embodiment of the brake device functions in the following way:

When the rider wishes to attach the board 5 to his/her feet, the brake device is in the braking position. The brake heel 3.1 is directed down into the snow, the brake loop 3.2 is not tensioned, and the lever 4.3 of the locking device is lying down on the base part of one binding 6. The locking device 4 is then already in the position which locks the brake device in the non-braking position.

The rider thus places one of his/her feet in the binding 6 where the lever 4.3 of the locking device is lying on the base part of the binding. When the rider has fitted this foot to the board, he/she uses his/her other foot to move the brake heel 3.1 towards the board, into a locked non-braking position. The rider can also bend down and take hold of the brake heel 3.1, but this is not necessary. The brake heel 3.1 is rotated up from the snow and in over the board 5 in a single movement. The act of raising the brake heel also causes the parts of the brake loop 3.2 to rotate in relation to one another, in conjunction with which the brake loop 3.2, which acts as a spring, is tensioned. When moving the brake heel 3.1 into the desired stop position, the projecting part 3.3 of the brake heel 3.1 is brought into interaction with the locking device 4. The projecting part 3.3 of the brake heel 3.1 is placed behind a part, the hook 4.2, of the locking device 4. The part of the locking device 4 holds down the projecting part 3.3 so that the brake heal is held in place above the board, within the outer edges of the board, and essentially parallel with the board and stops the brake heel to move towards the snow.

The brake device is now fully locked and will only be displaced into its braking position when the rider himself/herself releases and moves the foot which is standing on the lever 4.3. This description must not be regarded as a restriction of the invention, but rather as an aid to the full appreciation thereof. Many different embodiments, constructions, choices of material and similar alternatives are conceivable within the idea of invention.

I claim:

1. A brake device for snowboards (5) comprising:

a fitting part (1, 2), attached to the board; and a braking part (3) movably attached to the fitting part (1, 2) so it can be maneuvered from a non-braking position, in which all parts of the braking part (3) are situated on top of the board (5) and within the boundary edges of the board, to a braking position in which the braking part (3) is situated essentially outside one of the boundary edges of the board and extends below the board (5); said braking part including:

a brake heel (3.1), which forms the active braking part of the device, and a pretensioned spring brake loop (3.2) which connects the brake heel (3.1) to the fitting part (1, 2), permits maneuvering of the brake heel (3.1) from the non-braking position to the braking position; and pretensions the brake heel in the non-braking position until it is released into the braking position.

2. A brake device in accordance with claim 1, wherein the brake loop (3.2) comprises two legs **(3.2*a* and *b*) connected to one another via a web (3.2*c*), the ends of the legs of the brake loop are pivotally mounted to the fitting part (1, 2), the web (3.2*c*) is situated in the brake heel (3.1), and the brake heel (3.1) is capable of displacement along one of the legs (3.2*a*) to enable it to be brought into locking engagement with the locking device (4)**.

3. A brake device in accordance with claim 1, wherein the brake loop (3.2) comprises two legs **(3.2*a* and *b*), one end of each leg (3.2*a* and b) being pivotally mounted to the fitting part (1, 2), and the other end of each leg is situated in the brake heel (3.1)** in a rigidly fixed way.

4. A brake device in accordance with claim 3, wherein the brake heel (3.1) comprises a projecting part (3.3) arranged to interact with a part of the locking device (4) when the braking heel (3.1) is in non-braking position.

5. A brake device in accordance with any one of claims 1–4 wherein the locking device (4) is elongated and fastened to of the fitting part (1, 2) in such a way that it can be caused to rotate about its own longitudinal axis, one end of the brake device projects from the fitting part in the form of a hook (4.2) to lock the brake heel (3.1), and the other end of the braking device projects from the fitting part in the form of a lever (4.3), arranged to fall in towards the board (5) and lie essentially parallel with and above a base part of the binding (6) when the lever is retained in that position by a rider's foot the braking device can be moved into engagement with the hook (4.2) and locked thereby so long as the lever is engaged by the rider's foot.

6. A brake device in accordance with claim 5, wherein the drake heel (3.1) in the braking position is in an end position which is rigid in one direction of movement of the board (5) and is spring-assisted in the other direction of movement of the board (5).

7. A brake device in accordance with claim 2, wherein the brake heel (3.1) in the braking position is in an end position which is rigid in one direction of movement of the board (5) and is spring-assisted in the other direction of movement of the board (5).

8. A brake device in accordance with claim 1, wherein the brake heel (3.1) in the braking position is in an end position which is rigid in one direction of movement of the board (5) and is spring-assisted in the other direction of movement of the board (5).

9. A brake device in accordance with claim 1, wherein the brake heel (3.1) in the braking position is in an end position which is rigid in one direction of movement of the board (5) and is spring-assisted in the other direction of movement of the board (5).

10. A brake device in accordance with claim 4, wherein the brake heel (3.1) in the braking position is in an end position which is rigid in one direction of movement of the board (5) and is spring-assisted in the other direction of movement of the board (5).

11. A brake device in accordance with claim 3, wherein the brake heel (3.1) in the braking position is in an end position which is rigid in one direction of movement of the board (5) and is spring-assisted in the other direction of movement of the board (5).

12. A brake device in accordance with claim 1, further including a locking device (4) which locks the brake loop (3.2) and the brake heel (3.1) in the non-braking position and is movable into a position in which the brake loop (3.2) and the brake heel (3.1) are released so that they assume the braking position.

* * * * *